United States Patent [19]

Sharp et al.

[11] Patent Number: 4,893,551

[45] Date of Patent: Jan. 16, 1990

[54] FUME HOOD SASH SENSING APPARATUS

[75] Inventors: Gordon P. Sharp, Newton; Jerome J. Schaufeld, Framingham, both of Mass.

[73] Assignee: Phoenix Controls Corporation, Newton, Mass.

[21] Appl. No.: 196,029

[22] Filed: May 19, 1988

[51] Int. Cl.[4] ..... B08B 15/02

[52] U.S. Cl. ..... 98/115.3

[58] Field of Search ..... 98/115.1, 115.3

[56] References Cited

U.S. PATENT DOCUMENTS

| | | | |
|---|---|---|---|
| 3,440,022 | 4/1969 | Elmore | 98/115.3 X |
| 4,210,888 | 7/1980 | Holce | 335/207 |
| 4,213,110 | 7/1980 | Holce | 335/207 |
| 4,215,627 | 8/1980 | Garriss | 98/115.3 |
| 4,466,341 | 8/1984 | Grogan | 340/611 X |
| 4,528,898 | 7/1985 | Sharp et al. | 98/115.3 |
| 4,706,553 | 11/1987 | Sharp et al. | 98/115.3 |

FOREIGN PATENT DOCUMENTS

| | | | |
|---|---|---|---|
| 2076145 | 11/1981 | United Kingdom | 98/115.3 |

*Primary Examiner*—Harold Joyce

*Attorney, Agent, or Firm*—Wolf, Greenfield & Sacks

[57] ABSTRACT

An apparatus for sensing the extent to which the opening of a fume hood is uncovered by the hood sashes, and is particularly adapted for use with hoods having sashes which are moved horizontally. Radiation from a radiation emitter, such as an optical or a magnetic emitter, are sensed by corresponding detectors. For some embodiments of the invention, there is relative movement between the emitters and detectors as the sashes are moved to cover or uncover the opening, the movement between the emitter and the detector being such that the amount of radiation detected by the detectors is proportional to the uncovered portion of the opening. The relative movement may be accomplished by, for example, having the detectors fixed and having the emitters mounted to the sashes or by having the detectors mounted to some sashes and the emitters mounted to other sashes. A unique magnetic emitter is also provided with enhanced flux throw. The enhanced flux throw is required with various embodiments of the invention where there may be substantial spacing between the magnetic emitter and detector. Embodiments are also disclosed for practicing the invention with a fume hood having sashes which are adapted to be opened both vertically and horizontally.

38 Claims, 4 Drawing Sheets

FUME HOOD SASH SENSING APPARATUS

FIELD OF THE INVENTION

This invention relates to laboratory fume hoods and more specifically to apparatus for detecting the extent to which the sashes of a fume hood are open.

BACKGROUND OF THE INVENTION

A laboratory fume hood is a ventilated enclosure where harmful materials can be handled safely. The hood captures contaminants and prevents them from escaping into the laboratory by using an exhaust blower to draw air and contaminants in and around the hood's work area away from the operator so that inhalation of and contact with the contaminants are minimized. Access to the interior of the hood is through an opening which is closed with one or more sashes which may slide vertically, horizontally, or in both directions to vary the opening into the hood.

The velocity of the air flow through the hood opening is called the face velocity. The more hazardous the material being handled, the higher the recommended face velocity. Typical face velocities for laboratory fume hoods are 75 to 150 feet per minute (fpm), depending upon the application.

When an operator is working in the hood, the sash or sashes are opened to allow free access to the materials inside. The sash or sashes may be opened partially or fully, depending on the operations to be performed in the hood. While fume hood and sash sizes vary, the opening provided by a fully opened sash is typically on the order of ten square feet. Thus the maximum air flow which the blower must provide is typically on the order of 750 to 1500 cubic feet per minute (cfm).

The sash is closed when the hood is not being used by an operator. It is common to store hazardous materials inside the hood when the hood is not in use, and a positive airflow must therefore be maintained to exhaust contaminants from such materials even when the hood is not in use and the sash is closed.

It is important that the face velocity be kept as constant as possible. The minimum acceptable face velocity is determined by the level of hazard of the materials being handled, as discussed above. Too high a face velocity may cause turbulence, however, which can result in contaminants escaping from the hood. Additionally, high face velocities can be annoying to the operator and can damage fragile apparatus in the hood. As the hazard level of the materials being handled and the resulting minimum face velocity increases, maintaining a safe face velocity becomes more difficult.

Another important consideration in the design of a fume hood system is the cost of running the system. There are three major areas of cost: the capital expenditure of installing the hood, the cost of power to operate the hood exhaust blower, and the cost of heating, cooling and delivering the "make-up air" which replaces the air exhausted from a room by the fume hood. For a hood operating continuously with an opening of 10 square feet and a face velocity of 100 fpm, the cost of heating and cooling the make-up air, could, for example, run as high as two thousand dollars per year in the northeastern United States. Where chemical work is done, large numbers of fume hoods may be required, resulting in the make-up air costs being a significant portion of the HVAC cost for the facility. For example, the Massachusetts Institute of Technology has approximately 650 fume hoods, most of which are in operation 24 hours a day.

Reliability is another important factor in the design of a fume hood system. It is important that the face velocity of a fume hood not be allowed to go below a certain level. The amount of air being exhausted from a hood may be decreased by many common occurrences: duct blockage, fan belt slippage or breakage, deterioration of the blower blades, especially where corrosive materials are being handled, motor overload, and other factors. A reduction in air flow reduces the face velocity, and it is important to take immediate steps when a low flow condition occurs to prevent escape of contaminants from the hood.

A conventional fume hood consists of an enclosure which forms five sides of the hood and a hood sash or sashes which slide horizontally and/or vertically to provide a variable-sized opening on the sixth side. In this type of hood, the amount of air exhausted by the hood blower is essentially fixed, and the face velocity increases as the area of the sash opening decreases. As a result, the sash must be left open an appreciable amount even when the hood is not being used by an operator to allow air to enter the hood opening at a reasonable velocity. However, as is discussed in U.S. Pat. Nos. 4,528,898 and 4,706,553, the amount of energy required to deliver "make-up air" may be reduced by monitoring the sash position, and thus the opening in the fume hood, and by adjusting the blower and thus the exhaust volume of the hood linearly in proportion to the change in opening size in order to achieve a substantially constant face velocity. In these patents, the fume hood opening was covered by a single sash which opened in the vertical direction.

However, there are at least two other styles of fume hood which have advantages for various applications. In one such style, two or more sashes are mounted to slide horizontally on at least two tracks, the tracks being located at the top and bottom of the sash opening. This design is advantageous for energy conservation purposes since the maximum hood opening required to gain access to a particular area in the hood is reduced, reducing the exhaust volume of the hood. With, for example, a two-track, two-sash design, the maximum opening would be fifty percent of the total opening area, thus reducing the maximum exhaust volume of the hood by fifty percent. Another advantage of the horizontal sash design is that a sash can serve as a safety shield for the operator to work behind.

Maximum flexibility in minimizing the open area of a fume hood while providing full access to the hood is achieved with the third type of design wherein sashes mounted on tracks for horizontal movement are in turn mounted on a sash frame which may be moved vertically.

However, to achieve a constant face velocity with a fume hood design which utilizes horizontal moving sashes, a new method is required to measure the open sash area. This is because the absolute position of the sashes is not sufficient information by itself to indicate the open sash area of the hood. Instead, it is the relative position of the two or more sashes of the hood which determine the total open sash area. Measuring the absolute position of each sash and using this information to generate the amount of overlap of the sashes, and hence the open area, is achievable but is awkward and complex. This is particularly true where many sashes are involved, such as fume hood utilizing four sashes on two tracks (this being a very common configuration). The complexity of measuring sash openings in this way is even greater for fume hoods which utilize sashes movable both horizontally and vertically.

A simpler approach for sash area measurement is one which involves direct measurement of hood opening, something which is not possible with the prior art configurations.

Further, the sensing devices in the prior systems have involved sensors having elements on both sides of the sashes. This results in one of the elements being inside the fume hood where it is subjected to contaminants which may frequently be corrosive and thus may adversely affect the life and reliability of the sensor. Further, since horizontal sashes involve two tracks, rather than a single track as in the vertical sash devices, greater separation may exist between the sensor elements. Where one element of the sensor is a source of electromagnetic radiation such as a magnet and the other element of the sensor is a detector of the electromagnetic radiation, such as a magnetic flux detector, the separation between these two elements required with a two-track configuration may be greater than the distance which the flux from the magnet can effectively operate the detector. A need therefore exists for improved techniques for sensing sash position in a fume hood and in particular for both improved sensor elements and improved techniques for utilizing such elements for use with sashes mounted for horizontal movement.

SUMMARY OF THE INVENTION

In accordance with the above, this invention provides apparatus for sensing the extent to which the sashes in a fume hood cover the fume hood opening. The apparatus includes a source of radiation, a detector for the radiation, and means for mounting the radiation source and radiation detector such that there is relative movement between them as a sash is moved to cover or uncover an opening, the movement between the source and the detector being such that the amount of radiation detected by the detectors from the source is proportional to the uncovered portion of the opening. For preferred embodiments there are at least two of the sashes, which sashes are horizontally mounted and the detectors are mounted in a detecting bar which extends horizontally and may either be fixed and extend across the width of the hood opening, or may be mounted to one of the sashes. The radiation source and detectors may be magnetic flux emitters and magnetic flux detectors respectively. For preferred embodiments, the magnetic flux emitters utilized are magnetic strips formed of first and second elongated magnets, the magnets being mounted parallel to each other, being separated by a magnetically nonpermeable material, and having opposite poles facing the flux detectors. The poles of the magnets not facing the flux detectors may be connected by a strip of magnetically permeable material. When a detector bar is mounted to one of the sashes, the radiation source may be mounted to a second sash, the first and second sashes overlapping when the sashes are not fully covering the opening, and the detecting bar being mounted to receive radiation from the source when the sashes are overlapped. The unique magnetic emitters of this invention may also be utilized with the magnets mounted on one side of the sash or of extensions thereof, and the detectors mounted on the other side, whereby magnetic flux from the magnet may pass to the detector only when the sash is not covering the portion of the hood opening adjacent the detector. In another embodiment, a magnetically permeable strip is mounted on the sash closest to the detector when the sashes overlap. This strip shunts the flux from the magnet preventing it from reaching the detectors mounted in the fixed bar.

The invention may also be practiced using optical emitters and optical detectors. For one embodiment, the optical emitters and optical detectors are both mounted in the detecting bar in a manner such that radiation from a given emitter is reflected by a sash, if the sash is adjacent the emitter, to a corresponding detector, but is not reflected to the detector if the sash is not adjacent the emitter.

Finally, the teachings of this invention may be employed with fume hoods with sashes which are adapted to be opened both horizontally and vertically. The vertical opening of such sashes may be detected using conventional means or using the teachings of this invention. The horizontal opening is detected utilizing detectors of the type described above. The outputs from the horizontal and vertical detectors are then combined to determine the extent to which the fume hood opening is uncovered. Such determination may be made by simply adding the outputs from the two detectors, which outputs have been properly scaled, or by using more sophisticated processing which provides higher accuracy.

The foregoing and other objects, features and advantages of the invention will be apparent from the following more particular description of preferred embodiments as illustrated in the accompanying drawings.

IN THE DRAWINGS

DETAILED DESCRIPTION

Figure 1:
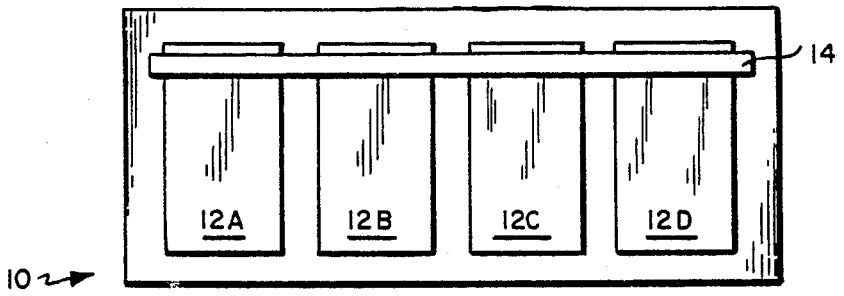
FIG. 1 is a front view of a fume hood having horizontally mounted sashes and having a detector bar of this invention.

FIG. 1 shows an exemplary fume hood 10, the front opening of which is covered by four horizontally mounted sashes 12A–12D. As will be discussed in greater detail hereinafter, the sashes 12 are typically mounted on two tracks with sashes 12A and 12C being mounted on one track and sashes and 12B and 12D being mounted on the other track so that adjacent sashes overlap when the sashes are open. In accordance with the teachings of this invention, the relative positions of the sashes 12, and thus the extent to which the fume hood opening is uncovered is directly measured by use of a horizontally mounted detecting bar 14. Bar 14 is fixed to the housing of hood 10 and extends across the entire hood opening, including all the sashes 12. The exact horizontal position of bar 14 relative to the sashes is not critical; however, the bar should be either near the top of the sashes as shown in FIG. 1 or near the bottom of the sashes so as to minimize interference with access to the hood through the opening.

Figure 2:
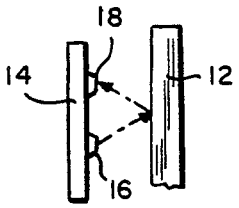
FIG. 2 is a schematic side view of a detector bar and portion of a sash for an optical embodiment of the invention.

Detector bar 14 may assume a number of different forms for different embodiments of the invention. For one embodiment of the invention, shown in FIG. 2, the bar 14 has a plurality of optical proximity detectors, each of which is made up of an optical emitter 16 and an optical detector 18. Optical emitter 16 may for example be a light emitting diode and optical detector 18 may be an optical transistor. In order to minimize spurious outputs caused by ambient light, it is preferable that the emitters and detectors utilized be of a type which operates in the infrared spectrum rather than in the visible spectrum. The effect of ambient light upon the operation of the unit may also be reduced by utilizing an emitter 16 which is a pulsed light source.

In operation, the light emitted by each emitter 16 is directed toward an adjacent portion of a sash 12. If sash 12 is not in an open position at that point along detecting bar 14, the light from emitter 16 is reflected off a surface of sash 12, for example a metallic surface of the sash frame, to detector 18. If the portion of frame 12 adjacent bar 14 is not sufficiently reflective, a horizontal light reflecting strip may be attached to the sash at a level where light from emitters 16 impinges on the sash.

Figure 3:
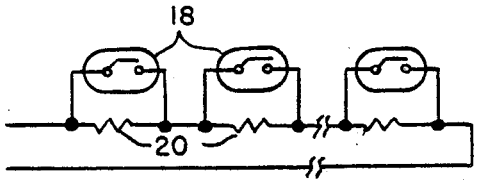
FIG. 3 is a schematic diagram of the electrical circuit for detector bar.

FIG. 3 is a schematic diagram illustrating the detector circuitry in bar 14. The photodetectors 18 may be considered to be switches, each of which is connected across a resistor 20. When light is not impinging on a detector 18, the resistance of the detector is so high that it may be considered an open circuit so that current applied to the series connected resistors 20 flows completely through the resistor 20 in parallel with the switch 18, causing a predetermined voltage drop across the resistor. However, when light impinges on detector 18, its resistance drops to substantially zero, providing a short circuit path around the corresponding resistor 20. The output signal level from the circuit shown in FIG. 3 is thus directly proportional to the number of switches 18 which are closed and thus to the positioning of the sashes 12. The output signal from the circuit of FIG. 3 may thus be made directly proportional to the uncovered portion of the fume hood opening and may be used in the manner discussed in the prior patents indicated above to control a fume hood blower or damper in order to maintain a constant face velocity.

The degree of accuracy achievable with the optical detector bar described above is a function of the number of optical proximity detectors utilized in the bar. However, since optical proximity detectors are relatively expensive devices, the cost of such an apparatus can be high, particularly if high accuracy in detecting sash position is desired, the accuracy of the apparatus being a function of the number of detectors and their spacing. Another potential disadvantage of the optical detector approach is that, even though the sensing bar 14 is outside the hood, smoke or vapor being exhausted may get between bar 14 and a sash 12, interfering with operation of the apparatus. For these and other reasons, a magnetic implementation, such as that shown in FIG. 4, may be preferred for many applications.

Magnetic detectors for use with vertical moving sashes are known in the art. In such detectors, a magnet or other magnetic flux emitter is positioned on one side of the sash track and a magnetic detector is positioned on the other side of the track. While this configuration may be utilized with vertical rising sashes, there are difficulties in attempting to utilize this approach with horizontal sashes. First, this approach, even when used with vertical sashes, results in either the magnet or emitter being located inside the hood where it may be subject to corrosion. In addition, the nature of the horizontal mounted configuration makes it more difficult to mount sensors to the tracks. Most important, since a double track configuration is utilized with horizontally mounted sashes, in order to detect relative position, the spacing between the magnet and the detector would be much greater than in vertically mounted sashes having a single track. One and a half to three inches might be a typical spacing with the horizontally mounted configuration. This distance is greater than the distance which most conventional magnets are capable of projecting substantial magnetic flux, making it difficult for the detectors to be actuated by the magnets and thus making this approach unsuitable for most horizontal sash applications.

Figure 4:
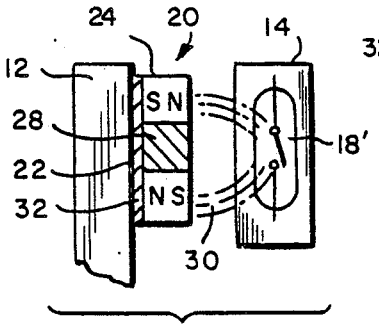
FIG. 4 is a side view of a detector bar and a portion of a sash with a magnetic emitter mounted thereto for a magnetic embodiment of the invention.

FIG. 4 illustrates a magnetic sensing apparatus which overcomes the various problems indicated above. In FIG. 4, the sensing bar 14 contains a plurality of spaced magnetic flux detectors 18' which may, for example, be reed switches or electronic hall effect digital switches. The number of such detectors and their spacing will depend on the size of the hood and on the desired accuracy. A typical spacing between detectors 18' might be one-half inch to one inch.

Mounted directly to the sashes 12 are the unique magnetic flux emitters 20 of this invention. The emitters 20 are in the form of flat magnets having a width of 0.20 inches to 1.0 inches, each of the magnetic strips 20 being mounted in line with and directly behind the bar 14. The magnetic strips 20 are secured to the sashes 12 by a suitable adhesive 22 and are formed of a first elongated magnet 24 oriented with its north pole facing bar 14 and an elongated magnet 26 oriented with its south pole facing bar 14, magnets 24 and 26 being substantially parallel and being separated by a strip 28 formed of a magnetically impermeable material. The strip 28 may be formed of a plastic or an air space may be substituted for the strip. The space between the magnets should be roughly equal to the width of one of the magnets. The magnetic flux output from magnet 20 in the direction of detecting bar 14 may be enhanced by connecting the poles of these magnets adjacent sash 12 with a strip 32 of steel or another magnetically permeable material.

The entire configuration 20 is relatively thin, projecting one-fourth inch or less from sash 12, so as to easily fit between the sash and bar 14.

Figure 6:
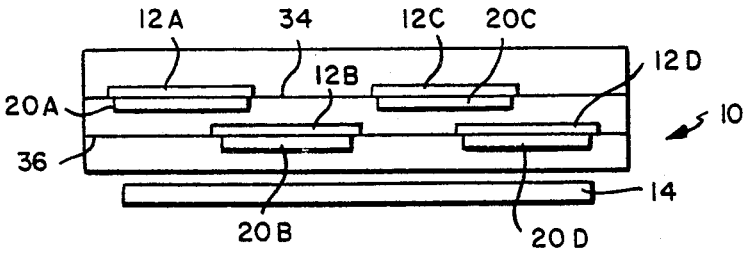
FIG. 6 is a top view of one magnetic embodiment of the invention.

In operation, flux 30 from emitter 20 impinges on a detector 18' in bar 14 when the sash is adjacent to the bar. Referring also to FIG. 6, it is seen that the sashes 12 with the attached magnetic emitters 20 are mounted on two tracks with sashes 12A and 12C being mounted on a rear track 34 further from bar 14 and sashes 12B and 12D being mounted on a forward track 36 closer to the bar 14. Thus, as a sash 12A or 12C is opened, it moves behind a corresponding sash 12B or 12D, while when a sash 12B or 12D is opened, it moves in front of a sash 12A or 12C. The detectors 18' which are energized directly indicate the area of the opening covered by sashes. The detectors not actuated provide a direct and linear indication of the total amount of open area of the hood. The circuitry in bar 14 for providing this indication to the hood blower or damper is the same as that shown in FIG. 3, with the magnetic detectors 18' being substituted for the optical detectors 18. As with the optical detectors, the magnetic detectors 18' function as open circuits when they are not receiving magnetic flux and function as substantially closed circuits when they are receiving magnetic flux from an emitter 20.

Figure 5:
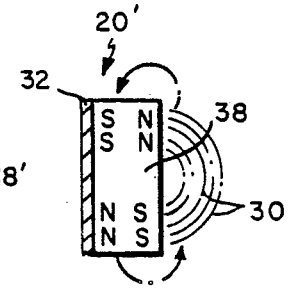
FIG. 5 is a diagram of an alternative magnet suitable for use as the magnetic emitter in the embodiment of FIG. 4.

Since magnetic flux from emitters 20A and 20C mounted to rear sashes 12A and 12C must span a distance in the order of 1.0 inch or more to reach detector bar 14 in a typical application, an emitter providing a long flux path is required. One way of achieving such a long flux path is to have a focussed flux pattern. The configuration shown in FIG. 4 is uniquely adapted for providing such a flux pattern and is therefore the preferred structure for implementing this invention. The maximum distance which can be spanned using the configuration of FIG. 4 is a function of, among other things, the strength of the magnets and the sensitivity of magnetic detectors. FIG. 5 illustrates another magnetic structure 20 which may be utilized to achieve the desired focussed, high-throw flux pattern utilizing a one-piece magnet 38. As is shown in FIG. 5, this magnet, shown in section in the figure, is polarized with a north pole facing detecting bar 14 along the upper portion of the magnet and a south pole facing the detecting bar along the lower portion of the magnet. These polarities could, of course, be reversed, as could the polarity of the magnets 24 and 26 in FIG. 4, with the lower portion of the magnet having a north pole facing the detecting bar and the upper portion having a south pole facing the bar. As for the embodiment of FIG. 4, the poles of magnet 38 adjacent a sash 12 are preferably connected by a strip 32 of permeable material to help increase the magnetic flux output.

Figure 7:
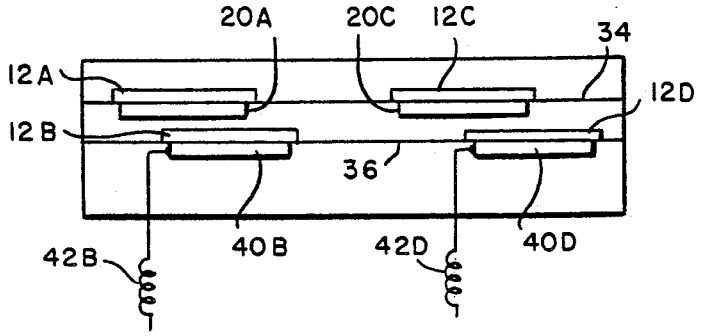
FIG. 7 is a top view of the sashes for an alternative embodiment of the invention.

FIG. 7 illustrates an alternative embodiment of the invention wherein instead of having a fixed detector bar 14 which extends across the entire width of the fume hood opening, detector bars 40B and 40D are attached to sashes 12B and 12D respectively in place of magnetic emitters 20B and 20D. The detector bars or strips 40 would be of the same form as detector bar 14 shown in FIG. 4, and would consist of a plurality of horizontally spaced magnetic flux detectors 18' such as reed switches or hall effect digital switches. Flexible cables or leads 42 are provided to connect detectors 40 to processing circuitry leading to the fume hood blower or other face velocity controller.

The configuration of FIG. 7 provides a number of advantages over that shown in FIG. 6. First, this configuration senses only overlap rather than absolute position of the sashes. Therefore, as is apparent from the figures, it requires utilization of only half the number of detectors to perform the detection function. Second, since outputs from the various detectors are summed in order to determine opening size, errors are also summed and accuracy is therefore a function both of the spacing between sensors, which determines the error at each sash edge where a determination is made, and the number of such determinations which must be made. With the configuration of FIG. 6, there are four edges at which determinations must be made (there is always some overlap between sashes so that no more than four edge determinations will ever have to be made, even though the indicated four sashes have a total of eight edges). However, with the configuration of FIG. 7, what is being determined is overlap and this determination is made at only two edges. Therefore, the configuration of FIG. 7 can obtain a given degree of accuracy achievable with the configuration of FIG. 6 with half of the sensor density of the configuration of FIG. 6. Thus, the actual number of magnetic flux detectors 18' required with the configuration of FIG. 7 is one-fourth of the number of such flux detectors required with the configuration of FIG. 6. Since the magnetic flux detectors can be relatively expensive items, and a substantial number of them are required for most fume hood applications to obtain a desired level of accuracy, a 75 percent reduction in the number of such detectors required results in substantially reduced apparatus costs.

Figure 8:
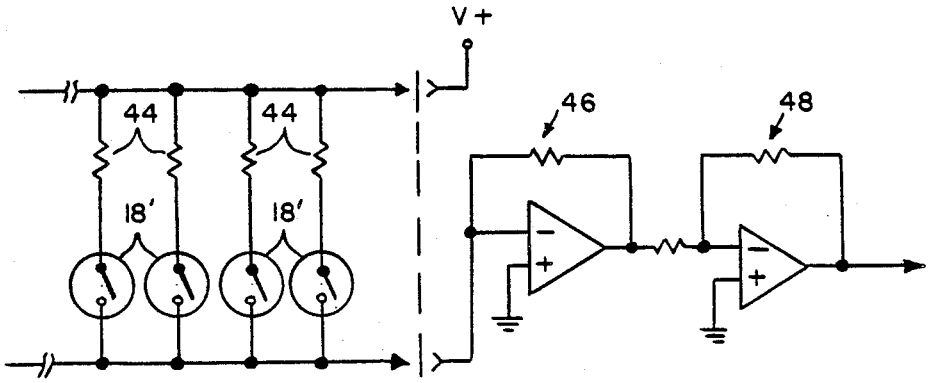
FIG. 8 is a schematic circuit diagram of the detector circuitry used with the embodiment of FIG. 7.

As was indicated above, the circuit of FIG. 7 measures overlap rather than sash position. The processing circuit to convert this output to an indication of opening size is thus slightly different than for the embodiment of the invention of FIG. 6. Referring to FIG. 8, instead of the configuration shown in FIG. 3 where a constant current is applied to the circuit and voltage drop is measured, in the circuit of FIG. 8, a constant voltage is applied across a circuit which includes parallel connected legs, each of which legs consists of a detector 18' and a resistor 44. The open or closed state of the detector switches 18' results in variable current drops across the circuit, the resulting current output from the circuit being a function of the overlap. This current signal is applied to a first op-amp circuit 46 which performs a 1/R conversion to obtain an output which is a negative function of the fume hood opening and through a second op-amp circuit 48 which converts this output to a positive function of the hood opening. While the circuit of FIG. 3 could be used with the apparatus of FIG. 7, such use would require additional processing over that shown in FIG. 3 to obtain the desired output as a function of fume hood opening.

Figure 9:
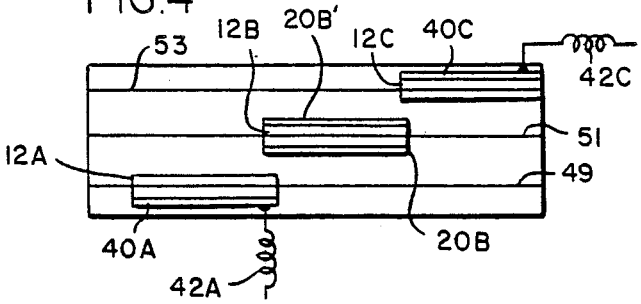
FIG. 9 is a top view for another alternative embodiment of the invention.

While in FIGS. 6 and 7 the sashes have been shown as being mounted on two tracks 34 and 36, there are fume hood designs utilizing three or more tracks. One such configuration is shown in FIG. 9 wherein three tracks (49, 51, and 53) are employed with a single sash 12 being mounted on each track. There are a number of different ways in which the teachings of this invention may be utilized with a fume hood of the type shown in FIG. 9. If a fixed bar approach such as that shown, for example, in FIGS. 1, 4 and 6 is utilized, the detector bar 14 would extend across the front of the fume hood opening in front of all three sashes and a magnet 20 would be mounted to the outer side of each of the sashes in alignment with the detector bar. This arrangement would closely resemble that shown in FIG. 6 except for the different arrangement of the sashes.

FIG. 9 illustrates how the moving detector bar approach of FIG. 7 may be modified for use with a three-track fume hood structure. In this embodiment, a magnet 20 is shown mounted to each side of sash 12B mounted on center track 51. A detector bar 40A is mounted to the outer side of sash 12A in alignment with magnet 20B and a detector bar 40C is mounted to the inner side of sash 12C in alignment with magnet 20B'. The operation of the apparatus shown in FIG. 9 to detect sash overlap, and thus the portion of the fume hood opening which is uncovered, is substantially similar to the operation of the apparatus of FIG. 7 in performing this function.

Figure 10:
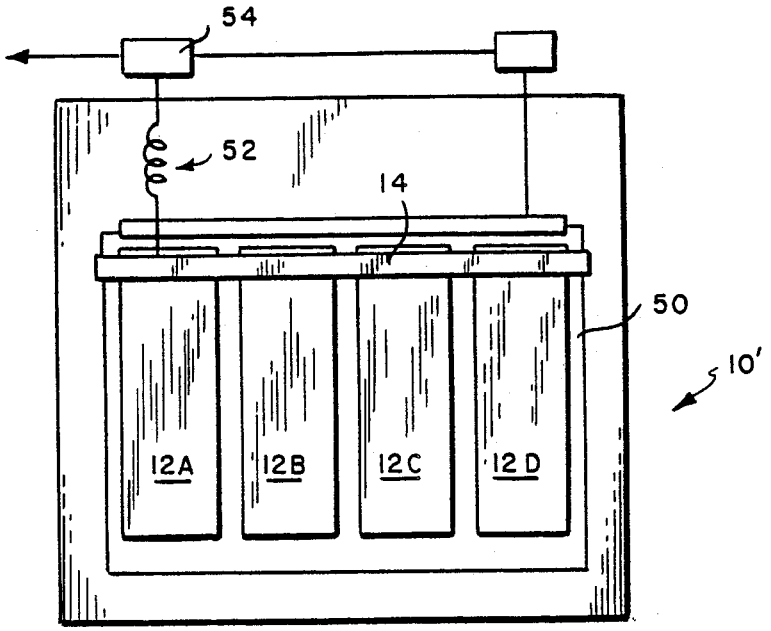
FIG 10 is a front view in somewhat schematic form of a fume hood having sashes which open both horizontally and vertically and employ the teachings of this invention.

Another major type of fume hood sash arrangement is a combination vertical and horizontal sash hood of the type shown in FIG. 10. In these hoods, two or more horizontally moving sashes 12 (four such sashes are shown in the figure) are mounted in a vertically rising sash assembly 50. With such a configuration, the sashes can be moved either vertically or horizontally, or can, if desired, be opened as a combination of both. To measure the combined sash opening, both horizontal and vertical sash sensing techniques must be employed.

The vertical height of the sash assembly can be measured with either a spring wound, cable 52 driven potentiometer 54 of the type described in detail in the two patents previously indicated, or the vertical position of the sash assembly 50 may be detected using an optical or magnetic technique of the type described earlier. The horizontal sash position could be measured using any of the techniques heretofore described (or described hereafter). For example, as shown in FIG. 10, the horizontal sash position could be detected utilizing a magnetic sensing bar 14 and configurations such as those shown in FIGS. 4 and 6. In this case, the fixed detecting bar 14 would be attached to sash assembly 50 rather than to the housing of the fume hood.

The combination sash arrangement of FIG. 10 requires special circuitry for generating a signal proportional to the total sash area. Two possible circuits for performing this function will be described.

The simplest approach involves adding the vertical sash sensor signal from, for example, potentiometer 54 to the horizontal sensor signal derived, for example, from the circuit shown in FIG. 3 (or the circuit shown in FIG. 8 if the configuration of FIG. 7 is utilized for horizontal sensing). Since the two signals are voltage signals obtained from resistances, the sensors can be wired in series to generate a resistance signal equal to the sum of the two openings. This approach requires that the gain of the two resistance signals be the same (i.e., that for a given change in opening area, both sensors generate the same resistance change, and thus voltage drop). If this cannot be achieved by varying the resistors in each sensor, then a scaling and summing circuit may be employed to combine the signals from the two sensors to achieve the desired uniform change. Such scaling and summing circuits are well known in the art.

However, the summing approach just described is accurate only when either the vertical sash assembly is fully closed or all of the horizontal sashes are fully closed. Any combination of sash position involving a partly open vertical assembly and a partly open horizontal sash will generate an error in the sash area signal. This is true because the outputs from each of the sensors being summed indicate area based on an assumption that there is no opening in the direction sensed by the other sensor. Therefore, when the sashes are open in both directions, each of the inputs beings sensed is slightly in error, resulting in the output also being in error. Depending upon the use of the hood and the degree of accuracy required for an application, this approach may provide acceptable results.

However, for applications where great accuracy is required, a more complex processing of the horizontal and vertical signals is required. In order to achieve complete accuracy in determining fume hood opening with combination sashes, the total sash opening area (A) should be determined using the following equation:

$$A = WS_v + (H - S_v)S_w$$

where:

W = fume hood opening width

Figure 11:
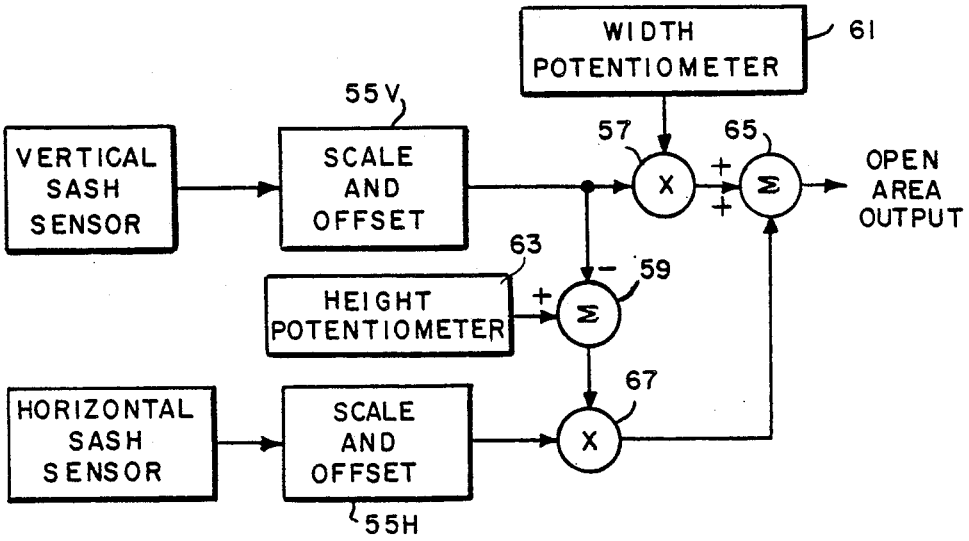
FIG. 11 is a schematic diagram of an electrical circuit for use with the embodiment of the invention shown in FIG. 10.

H = fume hood opening height $S_v$ = vertical sensor output after scaling and zero offset $S_w$ = horizontal sensor output after scaling and zero offset In the above equation, the variable signal outputs for both sensors have been appropriately scaled to the same inches/volt or inches/ohm scale factor. The sensor outputs have also been offset if necessary so that the appropriate sensors output is zero when either the vertical or horizontal opening is fully closed. The equation indicated above may be implemented using a variety of circuits, one of which is shown in FIG. 11. A circuit for performing the scaling and offset function in this figure is, for example, shown in FIG. 10 of the beforementioned U.S. Pat. No. 4,528,879. Since the circuit of FIG. 11 is a fairly straightforward implementation of the above equation, the operation of the circuit will not be described in detail. Basically, the outputs from the vertical and horizontal sash sensors are each passed through scale and offset circuitry as required. The output from the scale offset circuit of the vertical sash sensor is applied as one input to a multiplier 57 and as a negative input to summing circuit 59. The other input to multiplier 57 is the output from a width potentiometer 61, the output from circuit 61 being a voltage which is proportional to the width of the opening. The setting of potentiometer 64 may, for example, be a manual setting. Similarly, the other input to summing circuit 59 is a voltage output from height potentiometer circuit 63, this output being a voltage which is proportional to the height of the hood opening. The output from multiplier 57 is applied as one input to summing circuit 65. The output from summing circuit 59 and from horizontal scale offset circuit 55H are applied as the inputs to multiplier 67, the output from which is applied as the other input to summing circuit 65. The circuit output is taken at the output from summing circuit 65.

Figure 12:
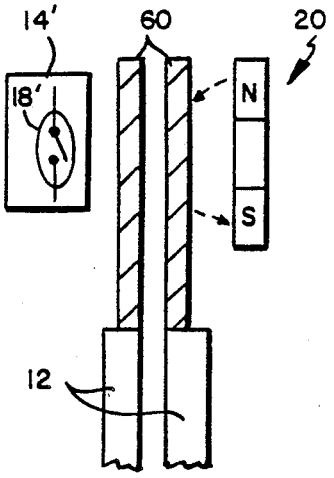
FIG. 12 is a side view of sashes and a magnetic detection circuit for an alternative embodiment of the invention.

While for most of the preferred embodiments, all portions of the sensor are outside the fume hood to avoid these components being corroded or otherwise damaged by contaminants being exhausted by the hood, the teachings of this invention, and in particular the magnetic emitters shown in FIGS. 4 and 5, are not limited to such configurations. Because of the focussed output from these magnetic emitters and the resulting long throw distance of the flux density from such emitters, it is possible to use such emitters in a configuration where the emitters and detectors are on opposite sides of the sashes. Where a detector element is located inside the hood, it may be desirable to coat or sheath the element so as to make it corrosion-resistant. One such configuration is shown in FIG. 12 where emitter 20 is mounted on one side of the sash track channel (for example, on the hood side of the sashes) and magnetic detectors 18' in a detector bar 14' are mounted on the other side of the channel. In this case, flags or brackets of magnetically permeable material are attached to the top of the horizontal sashes and extend above the sash opening to reduce the span between the emitter and detector and thus enhance the operation of the sensor. Further, instead of flags, magnetically permeable strips may be placed on the sashes themselves with the sensors and detectors placed in line with the strips. Flags 60 function to shunt flux from emitter 20 when the flag is between the emitter and detector, preventing flux from reaching the detector. When the sash is not between the emitter and detector, flux reaches the detector. A circuit such as that shown in FIG. 8 may be utilized with this configuration to obtain an indication of sash opening.

Figure 13:
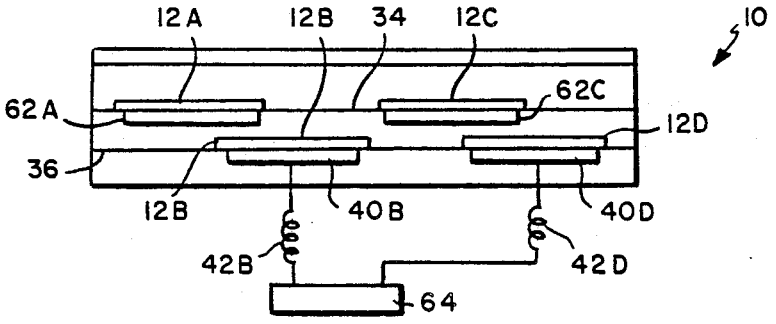
FIG. 13 is a top view of sashes and sensor apparatus for another alternative embodiment of the invention.

FIG. 13 shows still another configuration which is similar to that shown in FIG. 7 except that a single magnetic emitter bar 20 is mounted inside the fume hood and the emitters 20A and 20C in FIG. 7 have been replaced with strips of magnetically permeable materials 62A and 62C respectively. The circuit 64 shown in FIG. 13 may for example be the circuit of FIG. 3. In operation, the circuit of FIG. 13 senses overlap by permitting magnetic flux to reach detectors 40B and 40D only in areas where a strip 62A or 62C is not between emitter 20 and the detector.

Figure 14:
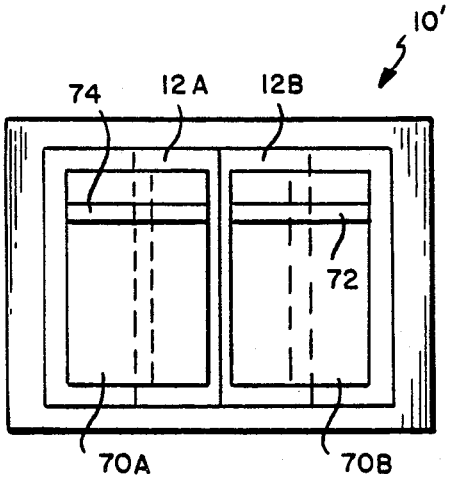
FIG. 14 is a front view of a fume hood of an alternative optical embodiment of the invention showing the hood closed in solid lines and the position of one of the sashes in a partially open position in dotted lines.

Further, while the optical technique has been discussed only in conjunction with the configuration of FIG. 1, the optical technique may also be utilized with many of the other configurations discussed above. For example, an optical emitter and detector could be used with the configuration of FIG. 12. FIG. 14 illustrates an optical configuration which functions in a manner equivalent to that shown in FIG. 7. For this embodiment of the invention, each of the sashes 12 is assumed to contain an optically transparent window 70. Attached to one of these windows, for example the window 70B of sash 12B which is assumed to be on outer track 36 is an optical detector strip 72 which contains optical emitters 16 and detectors 18 such as those shown in FIG. 2. Attached to the other window 70A is an optically reflective strip 74 which aligns with the strip 72 when the sashes overlap. When sash 12B is for example moved to the position shown in dotted lines, the sashes overlap. This overlap is detected by light being reflected from strip 74 to selected ones of the optical detectors 18. This output may be processed in the same manner previously described with reference to FIGS. 7 and 8 to obtain an indication of hood opening.

It should be understood that the various embodiments described above are merely illustrative of the manner in which the teachings of this invention may be utilized, and other permutations and combinations are possible. For example, in addition to being used for horizontally mounted sashes, or combination mounted sashes, the optical and magnetic techniques of this invention may also be utilized with standard vertical rising sashes. The various fixed sensing bar approaches can be readily adapted for use with vertical sashes. If the flux emitter is attached to the side of the fume hood, then the sliding sensor bar technique can also be used. The techniques of this invention may also be used with walk-in fume hoods which utilize two sashes on two tracks with the sashes both being of the vertical rising type.

Thus, while the invention has been particularly shown and described above with reference to a number of embodiments, the foregoing and other changes in form and detail may be made in the invention by one skilled in the art without departing from the spirit and scope thereof.

What is claimed is:

1. In fume hood having an opening for access to the interior thereof and at least two sashes for covering the opening, apparatus for sensing the extent to which the sashes cover the opening comprising:

a source of radiation;

means for detecting said radiation; and means for mounting said radiation source and said radiation detecting means such that there is relative movement between them as a sash is moved to cover or uncover an opening, the movement between the source and detector being such that the amount of said radiation detected by said detecting means from said source is proportional to the uncovered portion of said opening.

2. Apparatus as claimed in claim 1 wherein said sashes are horizontally mounted; and wherein said detecting means are mounted in a detecting bar which extends horizontally across the width of at least one of said sashes.

3. Apparatus as claimed in claim 2 wherein said detecting bar is fixed and extends across the width of said sashes.

4. Apparatus as claimed in claim 3 wherein said source and said detecting means are magnetic flux emitters and magnetic flux detectors respectively.

5. Apparatus as claimed in claim 4 wherein said magnetic flux emitters are in the form of horizontal magnetic strips mounted to the side of each of said sashes facing away from the hood at a point opposite said detecting bar so that the flux detectors in said bar are in the flux path of an adjacent portion of a magnetic strip.

6. Apparatus as claimed in claim 5 wherein said magnetic strip is formed of first and second elongated magnets, said magnets being mounted parallel to each other, being separated by a magnetically nonpermeable material, and having opposite poles facing the flux detectors.

7. Apparatus as claimed in claim 6 including a magnetically permeable material connecting the poles of said elongated magnets not facing the flux detectors.

8. Apparatus as claimed in claim 5 wherein said magnetic strip is formed of an elongated magnet the upper half of which is poled in one direction and the lower half of which is poled in the opposite direction.

9. Apparatus as claimed in claim 2 wherein said detecting bar is mounted to one side of a first one of said sashes; and wherein said radiation source is mounted to one side of a second one of said sashes, said first and second sashes overlapping when one of said sashes is not fully covering the opening, said detecting bar being mounted to receive radiation from said source when said sashes overlap.

10. Apparatus as claimed in claim 9 wherein the one side of said first sash and the one side of said second sash are two sides of said sashes facing away from the hood.

11. Apparatus as claimed in claim 9 wherein there are three of said sashes each mounted to a different track so that the sashes may overlap; and wherein a detecting bar or an emitter is mounted to each side of the sash on the middle one of said tracks, the remaining two sashes each having mounted to their side not adjacent the center sash an emitter if the adjacent side of the center sash has a detector bar or a detector bar if the adjacent side of the center sash has an emitter.

12. Apparatus as claimed in claim 9 wherein said source and said detecting means are magnetic flux emitters and magnetic flux detectors respectively.

13. Apparatus as claimed in claim 12 including means responsive to the output signal from said detectors for determining the extent to which said opening is not covered by sashes.

14. Apparatus as claimed in claim 2 wherein said sashes are mounted to be opened both horizontally and vertically;

wherein said detecting bar is operative to determine the amount of sash opening resulting from horizontal movement of the sashes; and including means for sensing the amount of sash opening resulting from vertical movement of the sashes; and means for utilizing the detected and sensed amounts of sash opening from horizontal and vertical movement of the sashes to determine the extent to which the fume hood opening is uncovered.

15. Apparatus as claimed in claim 14 wherein the sashes are in a vertically rising sash assembly; and wherein said detecting bar is attached to said sash assembly.

16. Apparatus as claimed in claim 14 wherein the means to determine the extent to which the opening is uncovered includes means for adding the output from said detecting bar a the output from said sensing means.

17. Apparatus as claimed in claim 16 including means for scaling at least one of said outputs before application to said adding means.

18. Apparatus as claimed in claim 14 wherein the means to determine the extent to which the opening is uncovered includes means for scaling the detected and sensed amounts, means for compensating for any zero offset error in said amounts, and means for processing the detected and sensed amounts to determine the total area (A) of the opening in accordance with the formula:

$$A = WS_v + (H - S_v)S_w$$

where:

W = fume hood opening width

H = fume hood opening height $S_v$ = vertical sensor output after scaling and zero offset $S_w$ = horizontal sensor output after scaling and zero offset.

19. In a fume hood having an opening for access to the interior thereof and at least one sash for covering the opening, apparatus for sensing the extent to which the sashes cover the opening comprising:

an elongated magnet, a first portion of the magnet being of one polarity along the entire length of the magnet and a second portion being of the opposite polarity along the entire length of the magnet, said first and second portions being spaced from each other;

means for mounting the magnet to emit magnetic flux in a predetermined direction;

a plurality of magnetic flux detectors mounted to be in the flux path of said magnet when the at least one sash is in a predetermined position relative to the magnet and/or the detector; and means responsive to the outputs of the detectors for providing an output indicative of the uncovered portion of the fume hood opening.

20. Apparatus as claimed in claim 19 wherein the first portion of the magnet is a first elongated magnet;

wherein the second portion of the magnet is a second elongated magnet mounted parallel to and substantially uniformly spaced from the first magnet; and including a magnetically nonpermeable material in the space between the magnets.

21. Apparatus as claimed in claim 20 including a magnetically permeable material connecting the poles of said elongated magnets on the side of the magnets opposite that from which flux is being emitted.

22. Apparatus as claimed in claim 19 wherein said elongated magnet is a single magnet, half of which magnet is said first portion and the other half of which magnet is said second portion.

23. Apparatus as claimed in claim 22 including a magnetically permeable material connecting the poles of said magnet portions on the side of portions opposite that from which flux is being emitted.

24. Apparatus as claimed in claim 19 wherein there are at least two of said sashes which sashes are horizontally mounted; and wherein said magnetic flux detectors are mounted in a detecting bar which extends horizontally across the width of at least one of said sashes.

25. Apparatus as claimed in claim 24 wherein said detecting bar is fixed and extends across the width of said sashes;

wherein one of said magnets is mounted to the side of each of said sashes outside the fume hood at a point opposite said detecting bar so that the flux detectors in said bar are in the flux path of an adjacent portion of a magnet.

26. Apparatus as claimed in claim 24 wherein said detecting bar is mounted to the side of a first one of said sashes facing away from the hood; and wherein said magnet is mounted to the side of a second one of said sashes facing away from the hood, said first and second sashes overlapping when one of said sashes is not fully covering the opening, said detecting bar being mounted to receive radiation from said source when said sashes overlap.

27. Apparatus as claimed in claim 19 wherein said magnet and detectors are mounted relative to a sash such that when the sash is in position to cover at least a part of the opening, the sash interrupts the flux path from the magnet to the detector.

28. Apparatus as claimed in claim 27 including a magnetically nonpermeable extension from the sash which is between the magnet and detectors and interrupts the flux path when the sash is in position to cover at least a portion of the opening.

29. Apparatus as claimed in claim 27 wherein there are at least two of said sashes which sashes are horizontally mounted and overlap when one of said sashes is moved to uncover the hood opening;

wherein said magnet extends horizontally along the width of said hood opening on one side of said sashes;

wherein the sash nearest the magnet when the sashes overlap has a horizontal strip of magnetically permeable material affixed to one side thereof which strip is horizontally aligned with the magnet; and wherein the sash farthest from the magnet when the sashes overlap has a horizontal row of flux detectors mounted to a side thereof which detectors are also horizontally aligned with the magnet.

30. In a fume hood having an opening for access to the interior thereof and at least one sash for covering the opening, apparatus for sensing the extent to which the sashes cover the opening comprising:

a plurality of optical emitters;

a plurality of optical detectors;

means for mounting said emitters and detectors relative to each other and to said sashes such that optical radiation emitted by a given emitter is reflected to a corresponding detector when a sash is adjacent to such emitter and collector; and means responsive to the outputs of the detectors for providing an output indicative of the uncovered portion of the fume hood opening.

31. Apparatus as claimed in claim 30 wherein said optical emitters and said optical detectors are both mounted in said detecting bar in a manner such that radiation from a given emitter is reflected by a sash to a corresponding detector, if the sash is adjacent the emitter, but is not reflected to the detector if a sash is not adjacent the emitter.

32. Apparatus as claimed in claim 31 wherein said sashes are horizontally mounted; and wherein said detecting bar is fixed and extends across the width of said sashes.

33. Apparatus as claimed in claim 31 wherein each of said sashes includes an optically transparent portion;

wherein said optical emitters and said optical detectors are both mounted in said detecting bar which bar is horizontally oriented and mounted to the side of the transparent portion of a first one of said sashes facing away from the hood;

wherein an optically reflective material is mounted to the transparent portion of a second of said sashes, said first and second sashes overlapping when one of said sashes is not fully covering the opening, optical radiation from the emitters being reflected by the reflective material to the corresponding optical detector when said sashes overlap.

34. Apparatus as claimed in claim 30 wherein said optical emitters and optical detectors are infrared emitters and infrared detectors respectively.

35. Apparatus as claimed in claim 30 wherein said optical emitter is a pulsed light source.

36. In a fume hood having an opening for access to the interior thereof and at least two sashes for covering the opening, apparatus for sensing the extent to which the sashes cover the opening comprising:

a source of radiation;

means for detecting said radiation; and means for mounting said radiation source and said radiation detecting means relative to each other and to said sashes such that the amount of radiation detected by said detecting means is proportional to the uncovered portion of said opening for each position of said sashes.

37. Apparatus as claimed in claim 36 wherein said source and said detecting means are magnetic flux emitters and magnetic flux detectors respectively.

38. Apparatus as claimed in claim 36 wherein said source and said detecting means are optical emitters and optical detectors respectively.

* * * * *